US005391307A

United States Patent [19]

Yamazaki et al.

[11] Patent Number: 5,391,307

[45] Date of Patent: Feb. 21, 1995

[54] LUBRICATING OIL COMPOSITION

[75] Inventors: Akira Yamazaki, Saitama; Setsuo Yoshida, Okazaki; Tatsuo Yoshioka, Toyota; Isamu Kawaji; Tadamori Sakakibara, both of Saitama, all of Japan

[73] Assignees: Tonen Corp., Tokyo; Toyota Jidosha Kabushiki Kaisha, Aichi, both of Japan

[21] Appl. No.: 942,950

[22] Filed: Sep. 10, 1992

Related U.S. Application Data

[62] Division of Ser. No. 548,076, Jul. 5, 1990, abandoned.

[30] Foreign Application Priority Data

Jul. 7, 1989 [JP] Japan ..... 1-174257
Jul. 7, 1989 [JP] Japan ..... 1-174258

[51] Int. Cl.[6] ..... C10M 169/04; C10M 141/00

[52] U.S. Cl. ..... 252/32.5; 252/33.3; 252/48.2; 252/49.6; 252/56 R; 252/56 S

[58] Field of Search ..... 252/32.7, 33.3, 32.5, 252/49.6, 48.2, 52 A, 56 R, 56 S

[56] References Cited

U.S. PATENT DOCUMENTS 2,285,853 6/1942 Downing et al. ..... 252/53
2,389,090 11/1945 Shields et al. ..... 252/56 R
3,357,920 12/1967 Nacson ..... 252/49.9
3,446,739 5/1969 Papayannopoulos ..... 252/56 R
3,634,239 1/1972 MacPhail et al. ..... 252/34.7
3,933,659 1/1976 Lyle et al. ..... 252/32.7 E
3,956,154 5/1976 Marolewski et al. ..... 252/56 R
4,105,571 8/1978 Shaub et al. ..... 252/56 R
4,370,247 1/1983 Ostyn ..... 252/56 R
4,486,324 12/1984 Korosec ..... 252/56 R
4,505,829 3/1985 Wisotsky ..... 252/56 R
4,637,885 1/1987 Kuwamoto et al. ..... 253/56 S

FOREIGN PATENT DOCUMENTS 0286996 10/1988 European Pat. Off. .
1180388 2/1970 United Kingdom .
1180389 2/1970 United Kingdom .

*Primary Examiner*—Margaret Medley
*Attorney, Agent, or Firm*—Michael N. Meller

[57] ABSTRACT

A lubricating oil composition comprising a base oil and, incorporated therein, a phosphoric acid ester, phosphorous acid ester, phosphoric acid ester amine salt or phosphorous acid ester amine salt, an aliphatic dicarboxylic acid compound, and an alkylamine compound and/or primary zinc thiophosphate, succinimide or perbasic magnesium or calcium sulfonate. The change with the lapse of time of the friction coefficient of this lubricating oil composition is small and the friction coefficient is stable, and the change of the friction coefficient by the change of the oil temperature is small. By dint of such excellent characteristics, this lubricating oil composition is especially valuable as a lubricating oil for an automatic transmission of an automobile.

12 Claims, No Drawings

LUBRICATING OIL COMPOSITION

This is a division of application Ser. No. 548,076, filed Jul. 5, 1990, now abandoned.

BACKGROUND OF THE INVENTION (1) Field of the Invention

The present invention relates to a lubricating oil composition. More particularly, the present invention relates to a lubricating oil composition to be used for an automatic transmission or a wet brake, especially an automatic transmission of an automobile.

(2) Description of the Related Art

Conventional lubricating oils for automatic transmissions of automobiles (hereinafter referred to as "ATF") are divided into two types, and ATF comprising a friction modifier (hereinafter referred to as "FM") incorporated therein, represented by oils satisfying the requirements of Dexron II Standard of GM Co., and an FM-free ATF represented by oils satisfying the requirements of M2C 33F (Type F) Standard of Ford Co.

Since type F ATF does not have FM, it is defective in that the transmission shock at the time of shifting is large and the comfort of an automobile is lowered.

Since FM is incorporated in the Dexron II type ATF, no transmission shock substantially occurs at the time of shifting in this ATF, or the transmission shock at the time of shifting is very small, if any. This state, however, is maintained only while the ATF is an almost fresh oil, and if the oil is deteriorated by heat or oxidation, the FM is consumed and the transmission shock increased.

In general, if the temperature of the ATF is low, for example, at the initial driving stage or when driving in a cold area, the transmission shock is large even if the ATF is a fresh oil. Various attempts have been made to control this transmission shock. For example, Japanese Unexamined Patent Publication No. 60-173097 proposes a lubricating oil composition comprising a base oil and, incorporated therein, (A) a trivalent or pentavalent phosphoric acid ester or an amine salt thereof and (B) at least one compound selected from the group consisting of a sorbitan fatty acid ester, a palm kernel oil fatty acid, a coconut oil fatty acid (each of the two former compounds is composed mainly of a glycerol ester of a higher fatty acid, that is, an oil and fat), a mixture of an oil and fat and a fatty acid, and a reaction product of a polyalkylene polyamine and a fatty acid (or an oxidized mineral oil). Japanese Unexamined Patent Publication No. 63-254196 proposes incorporation of a phosphoric acid ester, a phosphorous acid ester, an amine salt of a phosphoric acid ester, a carboxylic acid or a carboxylic acid amide as FM into a specific base oil. Furthermore, Japanese Unexamined Patent Publication No. 63-180000 proposes FM comprising a condensation product of an unsaturated fatty acid and an alkanolamine, Japanese Unexamined Patent Publication No. 63-66299 discloses FM comprising a combination of a fatty acid/alkanolamine reaction product and a fatty acid or an oil and fat, and Japanese Unexamined Patent Publication No. 62-84190 proposes incorporation of magnesium sulfonate as a metallic detergent into a base oil.

Investigations have been made into the obtaining of stable lubricating oils for automatic transmissions of automobiles, which do not cause transmission shock for a long period, but according to these investigations, including the above-mentioned proposals, lubricating oils which are satisfactory cannot be obtained, and further improvements are desired.

SUMMARY OF THE INVENTION

The present invention is based on the concept that, to control a transmission shock at the time of shifting in an automatic transmission of an automobile, as much as possible, selection of a specific friction moderator (FM) among various additives used for an automatic transmission lubricating oil (ATF) and control of the amount used of the friction modifier are important.

To cope with the phenomenon that the FM in an ATF is gradually lost during use and a transmission shock occurs, the incorporation of a large amount of FM is considered to be effective. Nevertheless, if the FM is incorporated in too large an amount, the friction coefficient is reduced and the slip is increased at the time of connection of a clutch, with the result that the shift time becomes long, the response characteristics are poor, and a response delay or blow-out occurs. Therefore, to solve the problem of the transmission shock due to a loss of the FM, it is important to select an FM which is not substantially lost during a high-temperature operation, i.e., an FM having a high stability against heat or oxidation.

Furthermore, in order to solve the problem of the transmission shock at a relatively low ATF oil temperature, it is important to use an ATF in which the change of the friction coefficient, caused by the change of the temperature, is small.

Taking the above into consideration, the inventors carried out further research, and as a result, found that by skillfully combining one or two FM's having a strong adsorption activity (the property that the component is adsorbed on a frictional surface causing the friction to lower the friction coefficient) at a low temperature, i.e., an activity of improving the friction characteristics at a low temperature, with one FM having a strong adsorption activity at a high temperature, i.e., an activity of improving the friction characteristics at a high temperature, namely two or three FM's as a whole, or further combining these FM's with a specific antiwear agent or a specific ash-free dispersant and a metallic detergent, and incorporating them into an ATF, there can be obtained an ATF composition having excellent characteristics against the change with the lapse of time and the temperature change. The present invention is based on this finding.

In accordance with a first aspect of the present invention, there is provided a lubricating oil composition comprising a base oil and, incorporated therein, the following components (i), (ii), (iii) and (iv) or (i), (iii) and (iv):

(i) at least one member selected from the group consisting of phosphoric acid esters, phosphorous acid esters and amine salts thereof represented by the following general formulae (1), (2), (3) and (4):

$$(RO)_l-\overset{\overset{\displaystyle O}{\|}}{P}-(OH)_{3-l}, \quad (1)$$

$$(RO)_m-\overset{\overset{\displaystyle O}{\|}}{P}-(OH)_{3-m}\cdot NH_nR'_{3-n}, \quad (2)$$

$$(RO)_l-P-(OH)_{3-l}, \text{ and} \quad (3)$$

-continued $$(RO)_m-P-(OH)_{3-m}\cdot NH_nR'_{3-n} \quad (4)$$

wherein l is an integer of from 1 to 3, m and n each represent an integer of 1 or 2, and R and R', which may be the same or different, represent an alkyl, aryl or alkyl-substituted aryl group having 4 to 30 carbon atoms, (ii) an alkylamine compound represented by the following general formula (5):

$$R''-\underset{\underset{R'''}{|}}{N}-R'''' \quad (5)$$

wherein R'', R''' and R'''' represent a hydrogen atom or an alkyl, aryl, alkyl-substituted aryl or alkanol group having 1 to 30 carbon atoms, (iii) an aliphatic dicarboxylic acid compound, and (iv) primary zinc thiophosphate.

In accordance with a second aspect of the present invention, there is provided a lubricating oil composition comprising a base oil and, incorporated therein, the following components (i), (ii), (iii), (v) and (vi) or (i), (iii), (v) and (vi):

(i) at least one member selected from the group consisting of phosphoric acid esters, phosphorous acid esters and amine salts thereof represented by the following general formulae (1), (2), (3) and (4):

$$(RO)_l-\overset{\overset{O}{||}}{P}-(OH)_{3-l}, \quad (1)$$

$$(RO)_m-\overset{\overset{O}{||}}{P}-(OH)_{3-m}\cdot NH_nR'_{3-n}, \quad (2)$$

$$(RO)_l-P-(OH)_{3-l} \text{ and} \quad (3)$$

$$(RO)_m-P-(OH)_{3-m}\cdot NH_nR'_{3-n} \quad (4)$$

wherein l is an integer of from 1 to 3, m and n each represent an integer of 1 or 2, and R and R', which may be the same or different, represent an alkyl, aryl or alkyl-substituted aryl group having 4 to 30 carbon atoms, (ii) an alkylamine compound represented by the following general formula (5):

$$R''-\underset{\underset{R'''}{|}}{N}-R'''' \quad (5)$$

wherein R'', R''' and R'''' represent a hydrogen atom or an alkyl, aryl, alkyl-substituted aryl or alkanol group having 1 to 30 carbon atoms, (iii) an aliphatic dicarboxylic acid compound, (v) succinimide, and (vi) perbasic magnesium or calcium sulfonate.

DESCRIPTION OF THE PREFERRED EMBODIMENTS

The FM component (i) constituting the lubricating oil composition of the present invention is at least one member selected from the group consisting of phosphoric acid esters, phosphorous acid esters and amine salts thereof represented by the above-mentioned general formulae (1), (2), (3) and (4), and this FM component shows a strong adsorption activity at a low temperature. As specific examples of the compound of this type, there can be mentioned phosphoric acid esters such as mono-(R) phosphate, di-(R) phosphate and tri-(R) phosphate, phosphorous acid esters such as mono-(R) phosphite, di-(R) phosphite and tri-(R) phosphite, phosphoric acid ester amine salts such as di-(R) phosphate mono-(R') amine salt and mono-(R) phosphate di-(R') amine salt, and phosphorous acid ester amine salts such as mono-(R) phosphite amine salt, in which R is butyl, hexyl, octyl, decyl, lauryl, myristyl, palmityl, stearyl, oleyl, phenyl or cresyl, and R' is the same as R except that phenyl and cresyl (aryl groups) are excluded.

The FM component (ii) constituting the lubricating oil composition of the present invention is an alkylamine compound represented by the above-mentioned general formula (5). Also this FM component (ii) has a strong adsorption activity (the property that the component is adsorbed on a frictional surface causing the friction to lower the friction coefficient) at a low temperature. In the general formula (5), two or all of R'', R''' and R'''' may be the same or different.

As examples of R'', R''' and R'''', there can be mentioned alkyl groups having 1 to 30 carbon atoms, alkyl-substituted aryl groups, and alkanol groups such as ethanol and propanol groups. From the viewpoint of the oil solubility, at least one of them is preferably an alkyl or alkyl-substituted aryl group having a chain length of at least 4 carbon atoms. As specific examples of the component (ii), there can be mentioned (a) monoamines such as butylamine, pentylamine, hexylamine, octylamine, laurylamine, octadecylamine, oleylamine and stearylamine, (b) diamines such as dibutylamine, dipentylamine, dihexylamine, dioctylamine, dilaurylamine, dioctadecylamine, distearylamine, stearyl monoethanolamine, palmityl monopropanolamine, decyl monoethanolamine, hexyl monopropanolamine, phenyl monoethanolamine and tolyl monopropanolamine, and (c) triamines such as tributylamine, tripentylamine, trihexylamine, trioctylamine, trilauryiamine, trioctadecylamine, trioleylamine, tristearylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, phenol diethanolamine, tolyl dipropanolamine, xylyl diethanolamine, diethanoiamine, and dipropanolamine.

The FM component (iii) constituting the lubricating oil composition of the present invention is an aliphatic dicarboxylic compound. This FM component shows a strong adsorption activity at a high temperature. As specific examples of this component, there can be mentioned adipic acid, pimelic acid, suberic acid, azelaic acid, sebacic acid, undecanedioic acid (brassylic acid), dodecanedioic acid, tetradecanedioic acid, octadecanedioic acid, eicosanedioic acid and triacontanedioic acid, and esterification products between these dicarboxylic acids or anhydrides thereof and diethylene glycol, thiodiethylene glycol or a monoalkylene glycol.

In the lubricating oil composition of the present invention, the amount of FM [components (i), (ii) and (iii) or components (i) and (iii)] is 0.01 to 2.0% by weight, preferably 0.05 to 1.0% by weight. If the amount of FM is smaller than 0.01% by weight, the FM effect is poor and a transmission shock occurs. If the FM amount is larger than 2.0% by weight, as pointed out hereinbefore, slip is increased at the time of connection of a clutch because of the presence of too large an amount of FM.

In the lubricating oil composition of the present invention, if the weight ratio of FM [components (i) and (ii)] to FM component (iii) is in a broad range of 10/90 to 90/10, the intended effect can be attained, and if this weight ratio is from 25/75 to 75/25, the attained effect is very high. Furthermore, if the FM component (i)/FM component (ii) weight ratio is from 10/90 to 90/10, the intended effect is attained, and if this weight ratio is from 25/75 to 75/25, the effect is very high. Moreover, if the FM component (i)/FM component (iii) weight ratio is in a broad range of from 20/80 to 80/20, the intended effect is attained, and if this weight ratio is from 40/60 to 60/40, a very high effect is attained.

A specific antiwear agent is incorporated in the lubricating oil composition of the present invention. In general, an antiwear agent is incorporated in a lubricating oil of this type. According to the present invention, it has been found that, to obtain a composition in which the friction characteristics are further improved while maintaining the wear resistance at a high level, the incorporation of primary zinc thiophosphate is preferable.

Zinc thiophosphate further includes secondary zinc thiophosphate, but this compound has a strong adsorptive force and inhibits the adsorption of FM to the friction surface. Zinc allyl thiophosphate has a weak adsorptive force and a poor wear resistance.

The primary zinc thiophosphate shows an adsorptive force intermediate between those of the above two compounds, and this compound per se shows a friction-reducing effect. The secondary zinc thiophosphate is further characterized in that the compound is little decomposed.

As the primary zinc thiophosphate, there can be mentioned compounds represented by the following general formula:

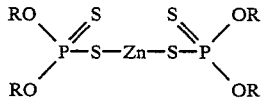

wherein R represents an alkyl group having 3 to 16 carbon atoms.

The amount of the component (iv) is preferably 0.05 to 1.00% by weight, most preferably 0.10 to 0.50% by weight. If the amount of the component (iv) is smaller than 0.05% by weight, the antiwear effect is low, and if the amount of the component (iv) is larger than 1.00% by weight, the adsorption of FM is inhibited, and $\mu o$ (final friction coefficient)/$\mu d$ (dynamic friction coefficient) increases and the friction characteristics are poor.

A specific ash-free dispersant is incorporated in the lubricating oil composition of the present invention. In general, an ash-free dispersant is incorporated in a lubricant of this type. It has been found that an addition of succinimide is preferable because succinimide is a compound capable of improving the friction characteristics while maintaining a good sludge-dispersing property.

The reason why the succinimide improves the friction characteristics has not been elucidated, but it is assumed that the reason may be as follows. The succinimide causes competitive adsorption with FM on the friction surface and increases the initial $\mu s$ (static friction coefficient) and $\mu o/\mu d$ while controlling the adsorption state of the FM, and as a result, the succinimide gives stable friction characteristics.

As the succinimide compound, there can be mentioned mono- and bis-alkyl succinimides represented by the following general formulae:

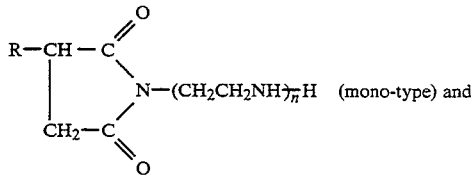

(1)

(mono-type) and

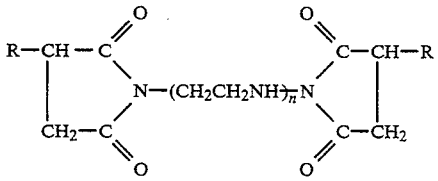

(2)

(bis-type)

wherein R represents an oligomer residue having a molecular weight of about 1000 and n is an integer of from 4 to 6, and boron-blocked succinimide. Among the above, boron-blocked succinimide is most preferably used.

The amount of the component (v) is preferably 1.00 to 10.00% by weight, most preferably 2.00 to 5.00% by weight. If the amount of the component (v) is smaller than 1.00% by weight, the dispersibility of deterioration products is poor, and $\mu s$ is reduced by the adsorption of FM. If the amount of the component (v) is larger than 10.00% by weight, $\mu o/\mu d$ is reduced by inhibition of the adsorption of FM and the friction characteristics are poor, and further, the abrasion resistance is low.

Furthermore, a specific metallic detergent is incorporated in the lubricating oil composition of the present invention. In general, a metallic detergent is incorporated in a lubricating oil of this type. According to the present invention, it has been found that incorporation of a perbasic sulfonate is preferable for improving the friction characteristics while maintaining cleanliness. The reason why the perbasic value sulfonate exerts the effect of improving the friction characteristics has not been elucidated, but it is assumed that the reason may be as follows. There are neutral and basic sulfonates, but it is considered that the perbasic value sulfonate controls the absorption state of FM by its strong basicity and exerts not only the effect of increasing $\mu d$ (dynamic friction coefficient) but also the effect of reducing $\mu o$ (final friction coefficient)/$\mu d$, which is the index of comfort (generation of transmission shock).

As the perbasic value sulfonate compound, there can be mentioned perbasic value magnesium sulfonate and perbasic value calcium sulfonate. By the perbasic value compound is meant a compound having a TBN (total base number) value of at least 300.

The amount added of the component (vi) is preferably 0.05 to 1.00% by weight and especially preferably 0.10 to 0.50% by weight. If the amount added of the component (vi) is smaller than 0.05% by weight, the cleaning effect is poor. If the amount of the component (vi) is larger than 1.00% by weight, the abrasion resistance is low. If the above-mentioned specific ash-free dispersant and metallic detergent are used in combination, the friction characteristics are synergistically improved.

In the lubricating oil composition of the present invention, known mineral oils and synthetic oils can be used as the base oil to which the above-mentioned components are added.

Solvent-refined or hydrofinished 60 neutral oil, 100 neutral oil, 150 neutral oil, 300 neutral oil and 500 neutral oil, and low-pouring-point base oils having a low-temperature flowability improved by removing wax components from these base oils can be mentioned as the mineral oil. These mineral oils can be used alone or in the form of mixtures comprising two or more thereof at appropriate ratios.

As the synthetic oil, there can be mentioned poly-$\alpha$-olefin oligomers, diesters, polyol esters and polyalkylene glycol. These base oils are generally used alone, but can be used in combination with the above-mentioned mineral oils. The synthetic oil/mineral oil mixing ratio is, for example, from 80/20 to 20/80.

In the present invention, the viscosity of the base oil is preferably 3 to 20 cSt as measured at 100° C.

The lubricating-oil composition of the present invention may further comprise a metal detergent selected from secondary zinc thiophosphate, zinc allyl thiophosphate, magnesium sulfonate and calcium sulfonate, an ash-free dispersant such as benzylamine, a viscosity improver and an antioxidant.

The lubricating oil composition of the present invention is characterized in that the change with time of the friction coefficient is small and the friction coefficient is stable, and the change of the friction coefficient by the change of the oil temperature is small. Accordingly, the composition is especially valuable as a lubricant for an automatic transmission of an automobile. Moreover, at the transmission shock sensory test on an actual automobile, it is found that when the lubricating oil composition of the present invention is used, the transmission shock is controlled at the time of shifting and a very good comfort is attained.

The present invention will now be described in detail with reference to the following examples, that by no means limit the scope of the invention.

EXAMPLES 1 THROUGH 7 AND COMPARATIVE EXAMPLES 1 THROUGH 3

Sample oils were prepared by .using variable amounts of FM (i), FM (ii) and FM (iii) as friction modifiers (the total amount was 0.5% by weight), an antiwear agent shown, other components shown and a base oil (refined mineral oil having a viscosity of 4.0 cSt as measured at 100° C.) as the common balance, as shown in Table 1 given below.

The friction characteristics of these sample oils were measured by using a friction tester (Model SAE No. 2 supplied by Automax Co., Japan).

The friction test included a dynamic test and a static test. From the torque curves obtained at the respective tests, the torque value Td (dynamic friction torque), the torque value To (final friction torque) and the torque value Ts (static friction torque) were determined, and the corresponding friction coefficients $\mu d$ (dynamic friction coefficient), $\mu o$ (final friction coefficient) and $\mu s$ (static friction coefficient) were calculated according to the following formula (1):

$$T = nr\mu F \quad (1)$$

wherein T represents the torque, n represents the number of planes, $\mu$ represents the friction coefficient, and F represents the pressing force. The results are shown in Table 1.

TABLE 1

| | | | | Example No. | | | | | | | Comparative Example No. | | |
|---|---|---|---|---|---|---|---|---|---|---|---|---|---|
| | | | | 1 | 2 | 3 | 4 | 5 | 6 | 7 | 1 | 2 | 3 |
| Composition (% by weight) | FM (i) | dilauryl phosphate amine salt | | 0.3 | 0.3 | 0.3 | 0.3 | 0.3 | | 0.05 | 0.3 | 0.3 | 0.3 |
| | | dibutyl phosphate | | | | | | | 0.05 | | | | |
| | FM (ii) | oleylamine | | | | | | | 0.15 | | | | |
| | | butylamine | | | | | | | | 0.10 | | | |
| | FM (iii) | octadecanedioic acid | | | | | | | | 0.35 | | | |
| | | *-2 | | 0.2 | 0.2 | 0.2 | 0.2 | 0.2 | 0.3 | | 0.2 | 0.2 | 0.2 |
| | antiwear agent | primary zinc phosphate (iv) | | 0.1 | 0.3 | 0.6 | 0.3 | 0.2 | 0.1 | 0.1 | — | — | — |
| | | secondary zinc thiophosphate | | | | | 0.1 | 0.2 | | | — | — | 0.5 |
| | | zinc alloy thiophosphate | | | | | | | | | — | 0.5 | — |
| | metallic detergent | magnesium sulfonate *-1 | | 0.1 | 0.1 | 0.1 | 0.1 | 0.1 | 0.1 | 0.1 | 0.1 | 0.1 | 0.1 |
| | ash-free detergent | benzylamine | | 2.0 | 2.0 | 2.0 | 2.0 | 2.0 | 2.0 | 2.0 | 2.0 | 2.0 | 2.0 |
| Results | SAE Test No. 2 | 500 cycles | $\mu_s$ | 0.127 | 0.134 | 0.133 | 0.135 | 0.135 | 0.126 | 0.123 | 0.120 | 0.130 | 0.137 |
| | | | $\mu_d$ | 0.131 | 0.136 | 0.135 | 0.136 | 0.134 | 0.130 | 0.132 | 0.128 | 0.132 | 0.136 |
| | | | $\mu_o/\mu_d$ | 0.985 | 0.021 | 0.014 | 0.051 | 0.042 | 0.997 | 0.981 | 0.966 | 1.000 | 1.036 |
| | | 5000 cycles | $\mu_s$ | 0.132 | 0.145 | 0.143 | 0.148 | 0.144 | 0.134 | 0.135 | 0.140 | 0.144 | 0.150 |
| | | | $\mu_d$ | 0.136 | 0.139 | 0.138 | 0.139 | 0.136 | 0.137 | 0.138 | 0.130 | 0.135 | 0.141 |
| | | | $\mu_o/\mu_d$ | 0.997 | 1.029 | 1.016 | 1.063 | 1.048 | 0.982 | 0.974 | 0.954 | 1.007 | 1.057 |
| Stability against change with lapse of time | | | | good | good | good | good | good | good | good | bad | bad | fair |
| | SAE Test No. 2 (after 5000 cycles) | 60° C. | $\mu_s$ | 0.134 | 0.148 | 0.145 | 0.151 | 0.148 | 0.136 | 0.137 | 0.144 | 0.149 | 0.156 |
| | | | $\mu_d$ | 0.136 | 0.140 | 0.138 | 0.140 | 0.139 | 0.138 | 0.138 | 0.131 | 0.136 | 0.140 |
| | | | $\mu_o/\mu_d$ | 0.992 | 1.036 | 1.024 | 1.065 | 1.050 | 1.000 | 0.982 | 0.985 | 1.029 | 1.071 |
| | | 100 ° C. | $\mu_s$ | 0.132 | 0.145 | 0.143 | 0.148 | 0.144 | 0.134 | 0.135 | 0.140 | 0.144 | 0.150 |
| | | | $\mu_d$ | 0.136 | 0.139 | 0.138 | 0.139 | 0.136 | 0.137 | 0.138 | 0.130 | 0.135 | 0.141 |
| | | | $\mu_o/\mu_d$ | 0.997 | 1.032 | 1.016 | 1.063 | 1.048 | 0.982 | 0.974 | 0.954 | 1.008 | 1.057 |
| | | 120 ° C. | $\mu_s$ | 0.130 | 0.141 | 0.140 | 0.145 | 0.141 | 0.132 | 0.133 | 0.137 | 0.140 | 0.143 |
| | | | $\mu_d$ | 0.135 | 0.139 | 0.138 | 0.138 | 0.136 | 0.137 | 0.137 | 0.130 | 0.134 | 0.142 |
| | | | $\mu_o/\mu_d$ | 0.984 | 1.029 | 1.012 | 1.049 | 1.042 | 0.979 | 0.968 | 0.946 | 1.007 | 1.042 |

TABLE 1-continued

| | Example No. | | | | | | | Comparative Example No. | | |
|---|---|---|---|---|---|---|---|---|---|---|
| | 1 | 2 | 3 | 4 | 5 | 6 | 7 | 1 | 2 | 3 |
| Stability against change of temperature | good | good | good | good | good | good | good | good | fair | fair |

*-1: magnesium sulfonate (basic value = 100)
*-2: product obtained by reaction of the formula

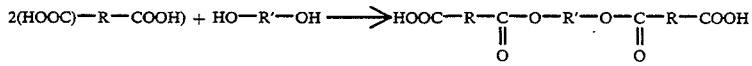

From the results shown in Table 1, it is seen that ATF of the present invention, i.e., ATF prepared by incorporating appropriate amounts of FM components having an excellent stability against heat or oxidation and showing a strong adsorption activity at a low temperature, FM component showing an adsorption activity at a high temperature and a specific antiwear agent, is characterized in that, at the friction test using SAE Tester No. 2, the change with the lapse of time is small and the friction coefficient is stable, and the friction coefficients measured while changing the oil temperature are stable.

EXAMPLES 8 THROUGH 11 AND COMPARATIVE EXAMPLES 4 THROUGH 7

Sample oils were prepared by using variable amounts of FM (i), FM (ii), and FM (iii) as the friction modifiers (the total amount was 0.5% by weight), other components shown and a base oil (refined mineral oil having a viscosity of 4.0 cSt as measured at 100° C.) as the common balance, as shown in Table 2.

The friction characteristics of the prepared sample oils were measured by using a friction tester (SAE No. 2 supplied by Automax Co., Japan).

The results are shown in Table 2.

From the results shown in Table 2, it is seen that ATF of the present invention, i.e., ATF prepared by using appropriate amounts of the FM component having an excellent stability against heat or oxidation and showing a strong adsorption activity at a low temperature and the FM component showing a strong adsorption activity at a high temperature and incorporating a specific ash-free dispersant and a specific metallic detergent, is characterized in that at the friction test using SAE Tester No. 2, the change with the lapse of time is small and the friction coefficient is stable, and the friction coefficients measured while changing the oil temperature are stable.

We claim:

1. A lubricating oil composition comprising a base oil and, incorporated therein, the following components (i), (iii), (v) and (vi):

(i) at least one member selected from the group consisting of phosphoric acid esters, phosphorous acid esters and amine salts thereof represented by the following general formulae (2) and (4):

TABLE 2

| | | | | Example No. | | | | Comparative Example No. | | | |
|---|---|---|---|---|---|---|---|---|---|---|---|
| | | | | 8 | 9 | 10 | 11 | 4 | 5 | 6 | 7 |
| Composition (% by weight) | FM (i) | dioleyl phosphate amine salt | | 0.15 | 0.30 | 0.15 | 0.30 | 0.15 | | 0.15 | |
| | | dilauryl phosphate | | | | | | | 0.40 | | 0.40 |
| | FM (ii) | oleyldiethanolamine | | | | | | | 0.05 | | 0.05 |
| | FM (iii) | octadecanedioic acid | | 0.35 | | 0.35 | | 0.35 | | 0.35 | |
| | | dodecanedioic acid | | | | | | | 0.05 | | 0.05 |
| | | *1 | | | 0.20 | | 0.20 | | | | |
| | antiwear agent | primary zinc phosphate | | 0.4 | 0.4 | 0.4 | 0.4 | 0.4 | 0.4 | 0.4 | 0.4 |
| | metallic detergent (vi) | perbasic value magnesium sulfonate *2 | | 0.3 | 0.3 | 0.10 | 0.50 | 0.0 | 0.0 | 0.3 | 0.3 |
| | ash-free detergent (v) | B-blocked succinimide | | 1.0 | 5.0 | 3.0 | 3.0 | 3.0 | 3.0 | 0.0 | 0.0 |
| Results | SAE Test No. 2 | 500 cycles | $\mu_s$ | 0.127 | 0.138 | 0.127 | 0.135 | 0.127 | 0.129 | 0.115 | 0.110 |
| | | | $\mu_d$ | 0.129 | 0.136 | 0.127 | 0.135 | 0.128 | 0.130 | 0.127 | 0.121 |
| | | | $\mu_o/\mu_d$ | 1.023 | 1.051 | 1.055 | 1.022 | 1.094 | 1.062 | 0.976 | 0.959 |
| | | 5000 cycles | $\mu_s$ | 0.134 | 0.145 | 0.133 | 0.141 | 0.115 | 0.116 | 0.129 | 0.118 |
| | | | $\mu_d$ | 0.134 | 0.143 | 0.132 | 0.138 | 0.140 | 0.140 | 0.132 | 0.124 |
| | | | $\mu_o/\mu_d$ | 1.000 | 1.063 | 1.063 | 1.015 | 1.021 | 1.007 | 0.985 | 0.976 |
| Stability against change with lapse of time | | | | good | good | good | good | fair | fair | fair | fair |
| | SAE Test No. 2 (after 5000 cycles) | 60° C. | $\mu_s$ | 0.138 | 0.146 | 0.136 | 0.140 | 0.120 | 0.118 | 0.132 | 0.123 |
| | | | $\mu_d$ | 0.135 | 0.143 | 0.134 | 0.139 | 0.141 | 0.140 | 0.133 | 0.126 |
| | | | $\mu_o/\mu_d$ | 1.037 | 1.070 | 1.060 | 1.022 | 1.021 | 1.021 | 0.992 | 0.992 |
| | | 100 ° C. | $\mu_s$ | 0.134 | 0.145 | 0.133 | 0.141 | 0.115 | 0.116 | 0.129 | 0.118 |
| | | | $\mu_d$ | 0.134 | 0.143 | 0.132 | 0.138 | 0.140 | 0.140 | 0.132 | 0.124 |
| | | | $\mu_o/\mu_d$ | 1.000 | 1.063 | 1.063 | 1.015 | 1.021 | 1.007 | 0.985 | 0.976 |
| | | 120 ° C. | $\mu_s$ | 0.132 | 0.138 | 0.130 | 0.134 | 0.113 | 0.112 | 0.127 | 0.115 |
| | | | $\mu_d$ | 0.133 | 0.142 | 0.131 | 0.136 | 0.138 | 0.137 | 0.127 | 0.120 |
| | | | $\mu_o/\mu_d$ | 1.000 | 1.049 | 1.046 | 1.015 | 1.007 | 1.000 | 0.984 | 0.967 |
| Stability against change of temperature | | | | good | good | good | good | good | good | good | good |

*1: product obtained by reaction of the formula

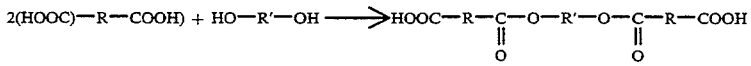

*2: total base number = 395

$$(RO)_m-\overset{\overset{\displaystyle O}{\|}}{P}-(OH)_{3-m}\cdot NH_nR'_{3-n} \quad \text{and} \tag{2}$$

$$(RO)_m-P-(OH)_{3-m}\cdot NH_nR'_{3-n} \tag{4}$$

wherein l is an integer of from 1 to 3, m and n each represent an integer of 1 or 2, and R and R′ and which may be the same or different, represent alkyl, aryl or alkyl-substituted aryl group having 4 to 30 carbon atoms, (iii) an aliphatic dicarboxylic acid compound, (v) boron-blocked succinimide, and (vi) perbasic magnesium sulfonate having a total base number value of at least 300, and wherein the components (i) and (iii) are 0.01 to 2.0% by weight.

2. A composition as set forth in claim 1, wherein the base oil comprises at least one mineral oil selected from the group consisting of solvent-refined or hydro-finished 60 neutral oil, 100 neutral oil, 150 neutral oil, 300 neutral oil and 500 neutral oil, and low-pour-point base oils having an improved low-temperature flowability, which are obtained by removing wax components from said mineral oils.

3. A composition as set forth in claim 1, wherein the base oil comprises a synthetic oil selected from the group consisting of poly-α-olefin oligomers, diesters, polyol esters and polyalkylene glycol.

4. A composition as set forth in claim 1, wherein the base oil is a mixture of at least one mineral oil selected from the group consisting of solvent-refined or hydro-finished 60 neutral oil, 100 neutral oil, 150 neutral oil, 300 neutral oil and 500 neutral oil, and low-pour-point base oils having an improved low-temperature flowability, which are obtained by removing wax components from said mineral oils, and a synthetic oil selected from the group consisting of poly-α-olefin oligomers, diesters, polyol esters and polyalkylene glycol.

5. A composition as set forth in claim 1, wherein the viscosity of the base oil is 3 to 20 cSt as measured at 100° C.

6. A composition as set forth in claim 1, wherein the component (i) comprises a phosphoric acid ester amine salt selected from the group consisting of di-(R) phosphate mono-(R′) amine salts and mono-(R) phosphate di-(R′) amine salts, in which R is butyl, hexyl, octyl, decyl, lauryl, myristyl, palmityl, stearyl, oleyl, phenyl or cresyl, and R′ is butyl, hexyl, octyl, decyl, lauryl, myristyl, palmityl, stearyl or oleyl.

7. A composition as set forth in claim 1, wherein the component (i) comprises a phosphorous acid ester amine salt selected from the group consisting of mono-(R) phosphite amine salts, in which R is butyl, hexyl, octyl, decyl, lauryl, myristyl, palmityl, stearyl, oleyl, phenyl or cresyl.

8. A composition as set forth in claim 1, wherein the aliphatic dicarboxylic acid compound as the component (iii) is selected from the group consisting of adipic acid, pimelic acid, suberic acid, azelaic acid, sebacic acid, undecanedionic acid (brassylic acid), dodecanedioic acid, tetradecanedioic acid, octadecanedioic acid, eicosanedioic acid and triacontanedioic acid, and esterification products between said dicarboxylic acids, or anhydrides thereof and diethylene glycol, thiodiethylene glycol or a monoalkylene glycol.

9. A composition as set forth in claim 1, wherein the mixing weight ratio of the component (i) to the component (iii) is from 20/80 to 80/20.

10. A composition as set forth in claim 1, wherein the amount of the component (v) is 1.00 to 10.00% by weight based on the lubricating oil composition.

11. A composition as set forth in claim 1, wherein the amount of the component (vi) is 0.05 to 1.00% by weight based on the lubricating oil composition.

12. A composition as set forth in claim 4, wherein the synthetic oil/mineral oil mixing ratio is from 80/20 to 20/80.

* * * * *